United States Patent [19]

Nabozny

[11] Patent Number: 4,863,084

[45] Date of Patent: Sep. 5, 1989

[54] HIP HOLSTER GLOVES

[76] Inventor: Dawn M. Nabozny, Rte. 4, Box 274, Ashland, Wis. 54806

[21] Appl. No.: 198,937

[22] Filed: May 26, 1988

[51] Int. Cl.[4] ..... A45F 5/02; A41D 19/00; B65B 15/00

[52] U.S. Cl. ..... 224/253; 224/267; 224/220; 224/222; 2/161 R; 2/DIG. 7; 206/278; 206/438; 221/26; 221/185; 53/397

[58] Field of Search ..... 206/278, 438, 210; 2/161 R, 167, 168, 169, 243 B, 49 R, DIG. 7; 224/224, 226, 240, 253, 267, 219-222; 221/25, 26, 185; 53/397; 223/DIG. 2

[56] References Cited

U.S. PATENT DOCUMENTS

| | | | |
|---|---|---|---|
| 2,732,934 | 1/1956 | Hall | 206/278 |
| 3,285,406 | 11/1966 | Winesett | 221/26 X |
| 3,870,150 | 3/1975 | Hummel | 206/438 |
| 4,034,853 | 7/1977 | Smith | 206/278 |
| 4,351,067 | 9/1982 | Bartels | 2/160 |

FOREIGN PATENT DOCUMENTS

| | | | |
|---|---|---|---|
| 1560609 | 7/1974 | France | 2/49 R |

*Primary Examiner*—Henry J. Recla
*Assistant Examiner*—Robert Fetsuga
*Attorney, Agent, or Firm*—Warren A. Sturm

[57] ABSTRACT

A portable, disposable glove dispensing system which can be worn by the user, having a support and attachment plate member to which are securely attached a plurality of gloves, and optionally, a frangible line of detachment, waist strap members, apertures for attachment to the user's belt and a stabilizer band may be included.

7 Claims, 1 Drawing Sheet

HIP HOLSTER GLOVES

BACKGROUND OF THE INVENTION

1. Field of the Invention

The present invention relates to a device for the individual dispersal of gloves, and in particular, it relates to a system which is worn by the user for the easy and individual dispersal of gloves of the type frequently usedin the health professions.

2. Description of the Prior Art

Many occupations require the use of gloves yet gloves are frequently lost or misplaced especially when their use arises only at intermittent times thereby allowing for the gloves to become misplaced between uses. Therefore, there is a need for a readily accessible system that can be worn that provides for the easy and individual dispersal of gloves.

The need for a system for the easy and individual dispersal of gloves is particularly critical in the health care professions which have had to respond to the problems of communicable diseases. The appearance of Acquired Immune Deficiency Syndrome (AIDS) onto the health care scene has amplified this need. The Occupational Safety and Health Administration recommends that gloves be routinely worn by hospital and health care workers for self-protection while handling containers collecting urine, sputum, emesis, or bile, handling body dressings or instruments, or cleaning equipment exposed to body fluids. Many hospitals and health care centers are now requiring that health care workers wear gloves at any time in which they may come into contact with any bodily fluids of patients or residents. Used gloves must be discarded after use to avoid the danger of contamination and the spread of disease. Therefore, health care workers now must have immediate accessibility to gloves throughout the work day at any location in the hospital or health care center. Previously, health care workers maintained supplies of gloves in supply storage areas or have carried a small number in their pockets while at work for added convenience and portability. However, these practices have resulted in problems including the unavailability of gloves when needed because glove dispensers are not always at arms length or near the patients. Also, if the gloves are carried in pockets along with other items, such as a stethoscope, pencil, or paper, retrieving the gloves can result in the gloves being deposited on the floor or other unsanitary area. Easily it can be seen that these practices are not suitable in responding to today's health care requirements. Therefore, the need is apparent for a glove dispersal system which provides for the easy and individual dispersal of gloves and can be worn by the user.

The Hummel U.S. Pat. No. 3,870,150 describes a sterile plastic glove and package assembly. The package serves as a convenient means for the user to insert his or her hand and as a receptacle for the glove once the glove has been used. However, Hummel does not disclose a readily accessible, wearable glove dispenser.

A sterile glove package and donning method is disclosed in the Poncy et al. U.S. Pat. No. 4,275,812 in which the glove is contained in a cylindrical ring through which the hand is inserted. The ring is then released disclosing a method whereby an individual can put on surgical gloves without assistance. Poncy also does not disclose a readily accessible, wearable glove dispenser.

A strip or roll of plastic film gloves is disclosed i the Smith U.S. Pat. No. 4,034,853 in which gloves are prepared from plastic film material, heat sealed in the outline of a hand and die cut to remove excess material. The gloves can be dispensed in roll or stacked form. Smith does not disclose a portable system which will easily and individually dispense gloves of the thin, flexible type.

A system for dispensing rain ponchos is disclosed in the Goldenberg U. S. Pat. No. 4,390,096. This system provides for the dispersal of a roll of frangibly interconnected rain ponchos from a dispenser which can be worn by the user. This system has the disadvantage of having to dispense the desired items in roll form.

An attachment mechanism for outdoor work gloves is disclosed in the Bartels U.S. Pat. No. 4,351,067. The attachment mechanism allows the gloves to be releasably connected to one another or removably attached to a workmen's belt by use of strips of mating hook weave connecting surfaces. A disadvantage of the Bartels patent is that it cannot be effectively adapted for usage with thin, flexible, disposable gloves.

SUMMARY OF THE INVENTION

The present invention provides for a system that easily and individually dispenses gloves of the type used in the health professions. The open wrist portion of the gloves are attached to a plate member. Near one end of each glove is a frangible line which runs the circumference of the glove and allows for the easy and individual detachment of the gloves. The system can be easily worn around a person's waist by using the belt provided as part of the system or the system can be worn in conjunction with a conventional belt.

DETAILED DESCRIPTION OF THE PREFERRED EMBODIMENT

Figure 1:
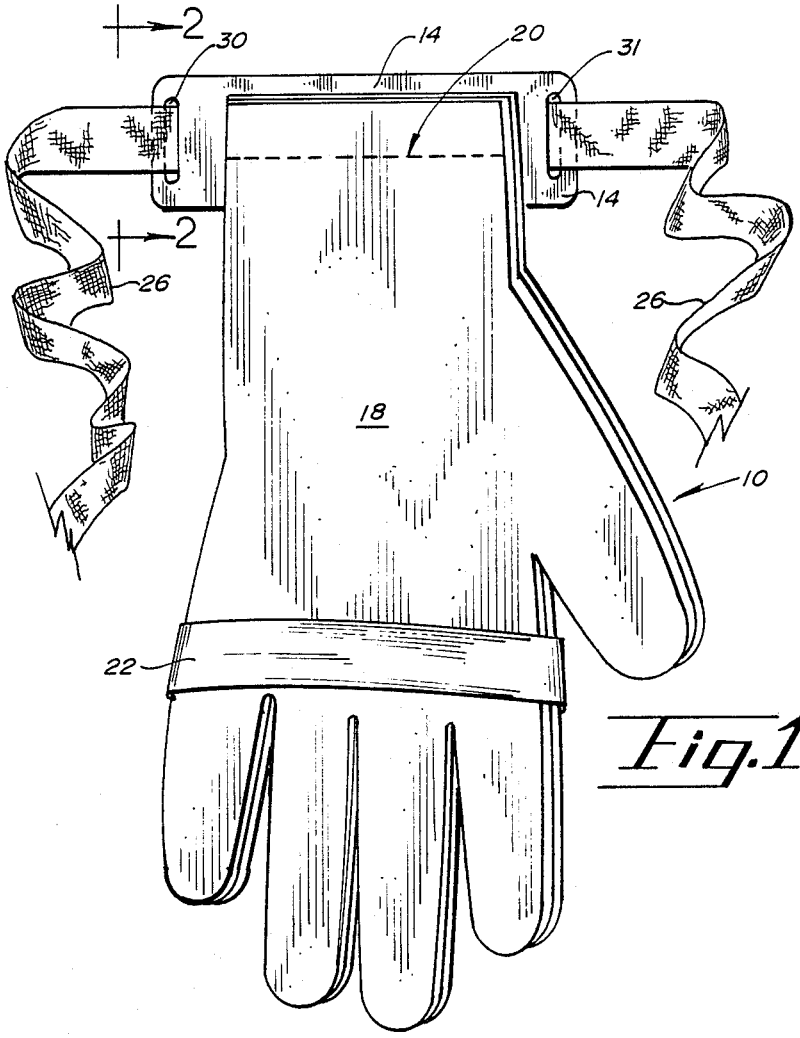
FIG. 1 is a side elevational view of the system of the present invention.

The system of the present invention is generally illustrated at reference character 10 in FIG. 1. The system includes a support and attachment plate member illustrated at reference character 14 and a plurality of gloves illustrated at reference character 18.

Plate member 14 serves the purposes of providing a flat support surface upon which gloves 18 are attached and provides an attachment surface of system 10 to be connected either to a self-belt or to be used in conjunction with a belt being worn by the person desiring to use the system. Plate member 14 is constructed of a sturdy, disposable material, such as cardboard or rigid plastic.

Figure 2:
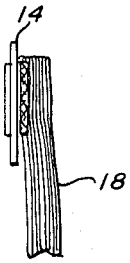
FIG. 2 is fragmentary cross-sectional view illustrating the attachment area of the system of the present invention.

Gloves 18 are attached to plate member 14 by a method which holds the gloves securely in place and is capable of withstanding the strain exerted when gloves 18 are detached for use. Suitable methods for attachment include sewing, use of adhesives, fusing with heat, stapling and the like. Gloves 18 are detached from plate member 14 by manually pulling each individual glove 18 away from the plate member 14 resulting in glove 18 detaching without damage to glove 18. Preferrably, glove 18 detaches at a line of perforations 20 near the wrist portion of each of the gloves whereby each of the gloves will easily detach from the plate member with a minimal amount of effort. Gloves 18 are then used in a conventional manner for the intended purpose. The type of gloves suitable for use in the system include conventional gloves having open wrists and closed fingers and which are thin, elastomeric, flexible, and sturdy of the type commonly used by the health professions. However, other similar gloves, such as sterile gloves, surgical gloves or gloves of other materials or thicknesses of material are also envisioned to be encompassed by the present invention. Use of the present invention is also envisioned to extend beyond the health professions to encompass general laboratory usage, gardening, and any other activity which can require occasional use of thin, flexible gloves. Gloves of these types generally are usable for right and left hands and therefore do not require special labeling or arrangement. Gloves 18 are attached to plate member 14 in groups of 10 to 20 depending on the thickness of the glove, the intended user, the technology used to attach the gloves, the material used in the manufacture of the gloves and other technical considerations. Gloves 18 are arranged and attached in a layered fashion, such that the flattened wrist portion of one glove is positioned substantially directly above the flattened wrist portion of the adjacent glove and so forth, as illustrated in FIG. 2.

A stabilizer,shnown in the form of a band 22, can be incorporated into the device for the purpose of maintaining the gloves 18 in a unitary state while in use by surrounding the portion of gloves 18 directly above the finger portion. Stabilizer band 22 would fit snugly around gloves 18, preferrably held in place by adhesive or the like, and therefore would maintain its position as gloves are individually removed from system 10. Stabilizer 18 can be manufactured of thin, disposable plastic, paper or any suitable material configured to accomplish the desired unitary state.

Waist strap members 26 are preferably incorporated into system 10 for the purpose of holding system 10 in position while in use. Strap members 26 are firmly attached to both side ends of plate member 14 by conventional attachment methods such as heat fusing, sewing or adhesives. Strap members 26 can also be incorporated into system 10 as a removable component by making a continuous unit of strap members 26 extending through end plate member 14. Strap members 26 must be of sufficient length to encompass a user's body member such as an arm or the waist. Strap members 26 are shown used to attach plate member 14 to the user of the device by surrounding the user's waist and held in place by tying, using materials such as those materials labeled under the tradename VELCRO, or other suitable means. Strap members 26 are fabricated of disposable plastic, paper, cloth or any suitable material that is capable of providing the necessary durability to hold the plate member securely in position on the user while in use.

An alternate embodiment of my system 10 includes attaching plate member 14 to the belt of the user by threading the user's belt through apertures 30 and 31 when putting the belt on, in which case the strap members are not provided or can be easily removed.

Another embodiment of my invention includes a clip(not shown) disposed on the rear side of of plate member 14 for engage ment with a portion , such as the belt or waist band or the like, of the apparel worn by the user.

Thus, it will be appreciated that the present invention provides a portable disposable glove dispensing system which dispenses gloves easily and individually and can be worn by the user which cannot be accomplished with the prior art dispensing or packaging patents.

I claim:

1. A portable disposable glove dispensing system which is capable of being worn by a person comprising:

(a) a flexible support and attachment plate member including means for attaching said support and attachment plate member to a person, (b) a plurality of gloves and means attaching said plurality of gloves in stacked formation to the support and attachment plate member at the open wrist portion of the gloves such that the gloves can be easily and individually detached from the support and attachment plate member.

2. The system of claim 1 and further including the gloves having a frangible line of detachment running the circumference of the wrist portion of each of the gloves.

3. The system of claim 1 wherein said means for attaching said support and attachment plate member to a person includes strap means for integrally interconnecting with the support and attachment plate member whereby the dispensing system may be worn around a person's waist.

4. The system of claim 1 and further including a stabilizer band to assist in maintaining the finger portion of each of the gloves in a steady position while in use.

5. The system of claim 1 wherein the gloves are utility gloves.

6. The system of claim 1 wherein the gloves are surgical gloves.

7. The system of claim 1 wherein the gloves are plastic film gloves.

* * * * *